US009073343B2

(12) United States Patent
Hamazaki et al.

(10) Patent No.: US 9,073,343 B2
(45) Date of Patent: Jul. 7, 2015

(54) IMAGE FORMING APPARATUS, IMAGE FORMING METHOD, AND NON-TRANSITORY COMPUTER READABLE MEDIUM

(71) Applicant: FUJI XEROX CO., LTD., Tokyo (JP)

(72) Inventors: Toshinobu Hamazaki, Kanagawa (JP); Shinji Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/025,029

(22) Filed: Sep. 12, 2013

(65) Prior Publication Data

US 2014/0232773 A1 Aug. 21, 2014

(30) Foreign Application Priority Data

Feb. 20, 2013 (JP) ..... 2013-031482

(51) Int. Cl.
*B41J 29/393* (2006.01)
*B41J 2/21* (2006.01)

(52) U.S. Cl.
CPC ..... *B41J 2/2139* (2013.01)

(58) Field of Classification Search
CPC .... B41J 2/16579; B41J 29/393; B41J 2/2142; B41J 2/0451; B41J 2/125; B41J 2/2139; B41J 2/04596; B41J 2/165; B41J 2/04558
USPC ..... 347/19, 14, 9, 12, 40, 81
See application file for complete search history.

(56) References Cited

U.S. PATENT DOCUMENTS

| | | | | |
|---|---|---|---|---|
| 6,746,095 | B2 * | 6/2004 | Kobayashi et al. | 347/23 |
| 8,646,869 | B2 * | 2/2014 | Yamazaki | 347/19 |
| 2003/0058303 | A1 | 3/2003 | Tsutsumi | |
| 2003/0103098 | A1 | 6/2003 | Yashima et al. | |

FOREIGN PATENT DOCUMENTS

| | | |
|---|---|---|
| JP | 2003-136701 | 5/2003 |
| JP | 4743817 | 5/2011 |

* cited by examiner

*Primary Examiner* — Thinh Nguyen
(74) *Attorney, Agent, or Firm* — Fildes & Outland, P.C.

(57) ABSTRACT

An image forming apparatus includes: a plurality of nozzles that include a normal nozzle which is normal in ejection of liquid droplets and an abnormal nozzle which is abnormal in ejection of liquid droplets; a storage unit in which nozzle information capable of determining a non-ejection nozzle which does not eject liquid droplets at the time of image forming is stored to correspond to each of a plurality of different conditions; and a control unit that performs a control based on the nozzle information corresponding to at least one of the conditions related to the image forming such that liquid droplets are not ejected from the non-ejection nozzle, and performs a control based on the image information such that liquid droplets are ejected from the nozzles except the non-ejection nozzle among the plurality of nozzles.

8 Claims, 14 Drawing Sheets

FIG. 8A

MASK FILE MATRIX (400)

| PRINTING DENSITY \ PRINTING NUMBER | UP TO 10TH PAGE | UP TO 100TH PAGE | UP TO 500TH PAGE | UP TO 1000TH PAGE |
|---|---|---|---|---|
| 20% | MASK FILE 1 | MASK FILE 2 | MASK FILE 3 | MASK FILE 4 |
| 60% | MASK FILE 5 | MASK FILE 6 | MASK FILE 7 | MASK FILE 8 |
| 100% | MASK FILE 9 | MASK FILE 10 | MASK FILE 11 | MASK FILE 12 |

FIG. 8B

| | | |
|---|---|---|
| MASK FILE NO. | | 1 |
| DEFECTIVE NOZZLE NO. | | 33, 158, 3628 |
| PRINTING DENSITY | | 20% |
| PRINTING NUMBER | | 5 TO 10 PAGES |
| PAPER TYPE | | PLAIN PAPER |
| ENVIRONMENTAL CONDITION | TEMPERATURE | 20℃ |
| | MOISTURE | 50% |

FIG. 9A

MASK FILE MATRIX (402)

| PRINTING DENSITY \ PRINTING NUMBER | 1 TO 10 PAGES | 11 TO 100 PAGES | 101 TO 500 PAGES | 501 TO 1000 PAGES |
|---|---|---|---|---|
| NOT LOWER THAN 0%, NOT HIGHER THAN 20% | MASK FILE 1A | MASK FILE 2A | MASK FILE 3A | MASK FILE 4A |
| HIGHER THAN 20%, NOT HIGHER THAN 60% | MASK FILE 5A | MASK FILE 6A | MASK FILE 7A | MASK FILE 8A |
| HIGHER THAN 60%, NOT HIGHER THAN 100% | MASK FILE 9A | MASK FILE 10A | MASK FILE 11A | MASK FILE 12A |

FIG. 9B

| | | |
|---|---|---|
| MASK FILE NO. | | 1A |
| DEFECTIVE NOZZLE NO. | | 33, 158, 3628 |
| PRINTING DENSITY | | NOT LOWER THAN 0%, NOT HIGHER THAN 20% |
| PRINTING NUMBER | | 1 TO 10 PAGES |
| PAPER TYPE | | PLAIN PAPER |
| ENVIRONMENTAL CONDITION | TEMPERATURE | 15℃ TO 25℃ |
| | MOISTURE | 30% TO 70% |

FIG. 13 MASK FILE GROUP 1

510

(a)

| PAPER TYPE | | PLAIN PAPER |
|---|---|---|
| ENVIRONMENTAL CONDITION | TEMPERATURE | 20℃ |
| | MOISTURE | 50% |

| PRINTING DENSITY \ PRINTING NUMBER | 10TH PAGE | 100TH PAGE | 500TH PAGE | 1000TH PAGE |
|---|---|---|---|---|
| 20% | MASK FILE 1 | MASK FILE 2 | MASK FILE 3 | MASK FILE 4 |
| 60% | MASK FILE 5 | MASK FILE 6 | MASK FILE 7 | MASK FILE 8 |
| 100% | MASK FILE 9 | MASK FILE 10 | MASK FILE 11 | MASK FILE 12 |

410

512

(b)

| PAPER TYPE | | COATED PAPER |
|---|---|---|
| ENVIRONMENTAL CONDITION | TEMPERATURE | 20℃ |
| | MOISTURE | 50% |

| PRINTING DENSITY \ PRINTING NUMBER | 10TH PAGE | 100TH PAGE | 500TH PAGE | 1000TH PAGE |
|---|---|---|---|---|
| 20% | MASK FILE 13 | MASK FILE 14 | MASK FILE 15 | MASK FILE 16 |
| 60% | MASK FILE 17 | MASK FILE 18 | MASK FILE 19 | MASK FILE 20 |
| 100% | MASK FILE 21 | MASK FILE 22 | MASK FILE 23 | MASK FILE 24 |

412

514

(c)

| PAPER TYPE | | GLOSSY PAPER |
|---|---|---|
| ENVIRONMENTAL CONDITION | TEMPERATURE | 20℃ |
| | MOISTURE | 50% |

| PRINTING DENSITY \ PRINTING NUMBER | 10TH PAGE | 100TH PAGE | 500TH PAGE | 1000TH PAGE |
|---|---|---|---|---|
| 20% | MASK FILE 25 | MASK FILE 26 | MASK FILE 27 | MASK FILE 28 |
| 60% | MASK FILE 29 | MASK FILE 30 | MASK FILE 31 | MASK FILE 32 |
| 100% | MASK FILE 33 | MASK FILE 34 | MASK FILE 35 | MASK FILE 36 |

414

FIG. 14 MASK FILE GROUP 1A

510A (a)

| PAPER TYPE | | PLAIN PAPER |
|---|---|---|
| ENVIRONMENTAL CONDITION | TEMPERATURE | 15℃ TO 25℃ |
| | MOISTURE | 30% TO 70% |

| PRINTING DENSITY \ PRINTING NUMBER | 1 TO 10 PAGES | 11 TO 100 PAGES | 101 TO 500 PAGES | 501 TO 1000 PAGES |
|---|---|---|---|---|
| NOT LOWER THAN 0%, NOT HIGHER THAN 20% | MASK FILE 1A | MASK FILE 2A | MASK FILE 3A | MASK FILE 4A |
| HIGHER THAN 20%, NOT HIGHER THAN 60% | MASK FILE 5A | MASK FILE 6A | MASK FILE 7A | MASK FILE 8A |
| HIGHER THAN 60%, NOT HIGHER THAN 100% | MASK FILE 9A | MASK FILE 10A | MASK FILE 11A | MASK FILE 12A |

410A

512A (b)

| PAPER TYPE | | COATED PAPER |
|---|---|---|
| ENVIRONMENTAL CONDITION | TEMPERATURE | 15℃ TO 25℃ |
| | MOISTURE | 30% TO 70% |

| PRINTING DENSITY \ PRINTING NUMBER | 1 TO 10 PAGES | 11 TO 100 PAGES | 101 TO 500 PAGES | 501 TO 1000 PAGES |
|---|---|---|---|---|
| NOT LOWER THAN 0%, NOT HIGHER THAN 20% | MASK FILE 13A | MASK FILE 14A | MASK FILE 15A | MASK FILE 16A |
| HIGHER THAN 20%, NOT HIGHER THAN 60% | MASK FILE 17A | MASK FILE 18A | MASK FILE 19A | MASK FILE 20A |
| HIGHER THAN 60%, NOT HIGHER THAN 100% | MASK FILE 21A | MASK FILE 22A | MASK FILE 23A | MASK FILE 24A |

412A

514A (c)

| PAPER TYPE | | GLOSSY PAPER |
|---|---|---|
| ENVIRONMENTAL CONDITION | TEMPERATURE | 15℃ TO 25℃ |
| | MOISTURE | 30% TO 70% |

| PRINTING DENSITY \ PRINTING NUMBER | 1 TO 10 PAGES | 11 TO 100 PAGES | 101 TO 500 PAGES | 501 TO 1000 PAGES |
|---|---|---|---|---|
| NOT LOWER THAN 0%, NOT HIGHER THAN 20% | MASK FILE 25A | MASK FILE 26A | MASK FILE 27A | MASK FILE 28A |
| HIGHER THAN 20%, NOT HIGHER THAN 60% | MASK FILE 29A | MASK FILE 30A | MASK FILE 31A | MASK FILE 32A |
| HIGHER THAN 60%, NOT HIGHER THAN 100% | MASK FILE 33A | MASK FILE 34A | MASK FILE 35A | MASK FILE 36A |

414A

IMAGE FORMING APPARATUS, IMAGE FORMING METHOD, AND NON-TRANSITORY COMPUTER READABLE MEDIUM

CROSS-REFERENCE TO RELATED APPLICATIONS

This application is based on and claims priority under 35 USC 119 from Japanese Patent Application No. 2013-031482 filed on Feb. 20, 2013.

BACKGROUND

Technical Field

The present invention relates to an image forming apparatus, an image forming method, and a non-transitory computer readable medium.

SUMMARY

According to an aspect of the invention, an image forming apparatus including: a plurality of nozzles that include a normal nozzle which is normal in ejection of liquid droplets and an abnormal nozzle which is abnormal in ejection of liquid droplets; a storage unit in which nozzle information capable of determining a non-ejection nozzle which does not eject liquid droplets at the time of image forming is stored to correspond to each of a plurality of different conditions; and a control unit that performs a control based on the nozzle information corresponding to at least one of the conditions related to the image forming such that liquid droplets are not ejected from the non-ejection nozzle, and performs a control based on the image information such that liquid droplets are ejected from ejection nozzles except the non-ejection nozzle among the plurality of nozzles.

BRIEF DESCRIPTION OF THE DRAWINGS

Exemplary embodiment(s) of the present invention will be described in detail based on the following figures, wherein

FIGS. 8A and 8B are conceptual views illustrating states of storing mask files to the mask file storage unit at the time of preparing the mask files according to the first exemplary embodiment;

FIGS. 9A and 9B are conceptual views illustrating stored states of mask files in the mask file storage unit at the time of specifying the mask files according to the first exemplary embodiment;

FIG. 13 shows conceptual views illustrating states of storing mask files to the mask file storage unit at the time of preparing the mask files according to the second exemplary embodiment; and FIG. 14 shows conceptual views illustrating stored states of mask files in the mask file storage unit at the time of specifying the mask files according to the second exemplary embodiment.

DETAILED DESCRIPTION

Hereinbelow, exemplary embodiments of the present invention will be described in detail with reference to drawings.

[First Exemplary Embodiment]

Figure 1:
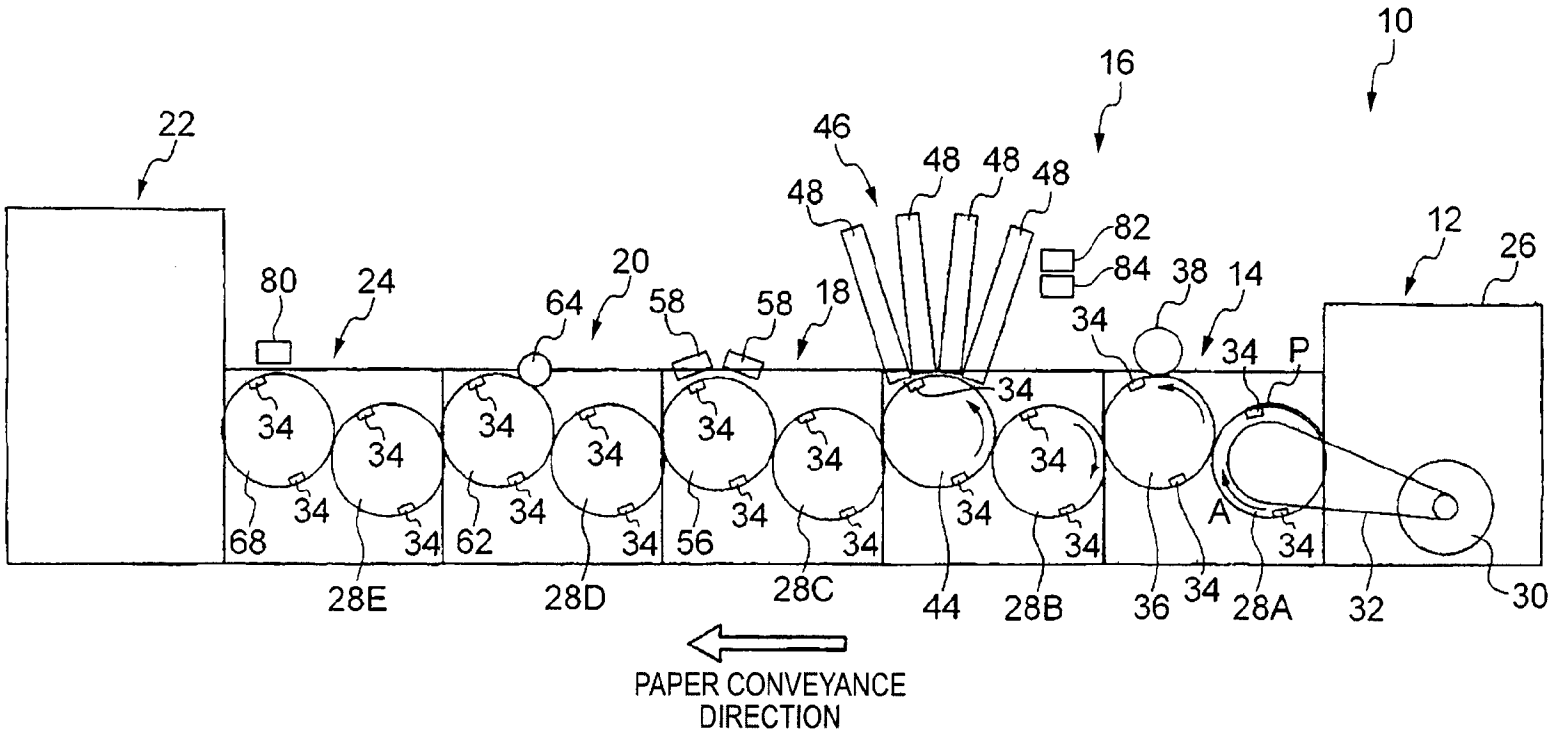
FIG. 1 is a side cross-sectional view illustrating a configuration of an image forming apparatus according to an exemplary embodiment.

FIG. 1 is a side cross-sectional view illustrating a configuration of an image forming apparatus 10 according to the present exemplary embodiment. As illustrated in the drawing, the image forming apparatus 10 is provided with a paper feed conveyance section 12 which feeds and conveys a record paper P as a record medium. At the downstream side in the conveyance direction of the paper feed conveyance section 12, a processing liquid application section 14 which applies a processing liquid which reacts with ink on a record surface (front surface) of the record paper P to agglomerate a color material (pigment) so as to facilitate the separation of a color material and solvent, an image forming section 16 which forms an image on a record surface of the record paper P, a drying section 18 which dries the image formed on the record surface, an image fixing section 20 which fixes the dried image to the record paper P, and a discharge conveyance section 24 which conveys the record paper to which the image is fixed to a discharge section 22 are sequentially installed in this order along the conveyance direction of the record paper P.

The paper feed conveyance section 12 is provided with an accommodation section 26 in which record papers P are accommodated. In addition, the accommodation section 26 is provided with a motor 30. The accommodation section 26 is also provided with a paper feed device (not illustrated) so that the record paper P is sent out from the accommodation section 26 to the processing liquid application section 14 by the paper feed device.

The processing liquid application section 14 includes an intermediate conveyance drum 28A and a processing liquid application drum 36. The intermediate conveyance drum 28A is rotatably disposed at an area where it is sandwiched between the accommodation section 26 and the processing liquid application drum 36, and a belt 32 is stretched over the rotation shaft of the intermediate conveyance drum 28A and the rotation shaft of the motor 30. Accordingly, the rotation driving force of the motor 30 is transmitted to the intermediate conveyance drum 28A via the belt 32 and thus, the intermediate conveyance drum 28A rotates in the direction of arrow A.

In addition, the intermediate conveyance drum 28A is provided with holding members 34 which holds a record paper P in a state where the leading end of the record paper P is laid therebetween. Thus, the record paper P sent out from the accommodation section 26 to the processing liquid application section 14 is held on the outer circumferential surface of the intermediate conveyance drum 28A via the holding members 34 and conveyed to the processing liquid application drum 36 by the rotation of the intermediate conveyance drum 28A.

Meanwhile, intermediate conveyance drums 28B to 28E, the processing liquid application drum 36, an image forming drum 44, an ink drying drum 56, an image fixing drum 62 and a discharge conveyance drum 68 to be described later are also provided with holding members 34 in the same way as the intermediate conveyance drum 28A. Further, the delivery of the record paper P from an upstream side drum to a downstream side drum is performed by the holding members 34.

The rotation shaft of the processing liquid application drum 36 is connected to the rotation shaft of the intermediate conveyance drum 28A through gears (not illustrated) and rotated by receiving rotation force from the intermediate conveyance drum 28A.

The record paper P conveyed by the intermediate conveyance drum 28A is delivered to the processing liquid application drum 36 via the holding members 34 of the processing liquid application drum 36 and conveyed in a state in which it is held on the outer circumferential surface of the processing liquid application drum 36.

At the upper side of the processing liquid application drum 36, a processing liquid application roller 38 is disposed in a state in which it is in contact with the circumferential surface of the processing liquid application drum 36. Thus, a processing liquid is coated on the record surface of the paper P on the outer circumferential surface of the processing liquid application drum 36 by the processing liquid application roller 38.

The record paper P coated with the processing liquid by the processing liquid application section 14 is conveyed to the image forming section 16 by the rotation of the processing liquid application drum 36.

The image forming section 16 includes an intermediate conveyance drum 28B and an image forming drum 44. The rotation shaft of the intermediate conveyance drum 28B is connected to the rotation shaft of the processing liquid application drum 36 through gears (not illustrated) to be rotated by receiving the rotation force of the processing liquid application drum 36.

The record paper P conveyed by the processing liquid application drum 36 is delivered to the intermediate conveyance drum 28B via the holding members 34 of the intermediate conveyance drum 28B of the image forming section 16 and conveyed in a state in which it is held on the outer circumferential surface of the intermediate conveyance drum 28B.

The rotation shaft of the image forming drum 44 is connected to the rotation shaft of the intermediate conveyance drum 28B through gears (not illustrated) and rotated by receiving the rotation force of the intermediate conveyance drum 28B.

The record paper P conveyed by the intermediate conveyance drum 28B is delivered to the image forming drum 44 via the holding members 34 of the image forming drum 44 and conveyed in a state in which it is held on the outer circumferential surface of the image forming drum 44.

At the upper side of the image forming drum 44, a head unit 46 is disposed in close vicinity to the outer circumferential surface of the image forming drum 44. The head unit 46 includes four ink jet recording heads which correspond to the four colors of yellow (Y), magenta (M), cyan (C), and black (K), respectively. The ink jet recording heads 48 are arranged along the circumferential direction of the image forming drum 44 to form an image by ejecting ink droplets from nozzles 48*a* to be described later in synchronization with a clock signal from a CPU 100 to be described later to overlap with the processing liquid layer formed on the record surface of the record paper P by the processing liquid application section 14.

From the nozzles of ink jet recording heads 48, a processing liquid may be ejected in some cases. However, in the present exemplary embodiment, a case where ink droplets are ejected will be described as an example.

Figure 3:
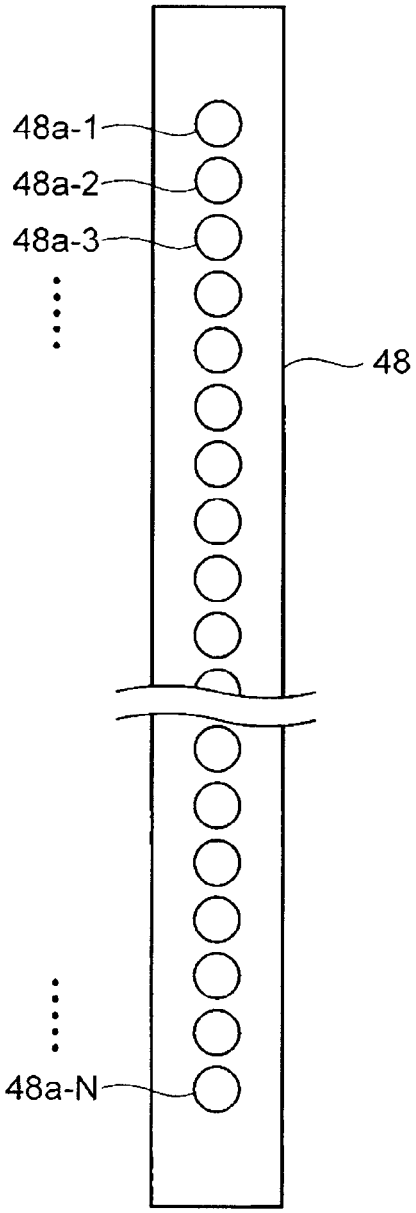
FIG. 3 is a bottom view illustrating a configuration of an ink jet recording head according to an exemplary embodiment.

FIG. 3 illustrates an arrangement of nozzles 48*a* in each ink jet recording head in the present exemplary embodiment.

In the present exemplary embodiment, the number and arrangement of the nozzles 48*a* of each ink jet recording head 48 are not particularly limited, but a configuration is employed in which N nozzles 48*a*-1, . . . , 48*a*-N are arranged in a row and the ink jet recording head 48 is formed in an elongated head to conform with the width length of the record paper P. Accordingly, the ink jet recording head 48 according to the present exemplary embodiment is a paper width print type (so-called Full Width Array (FWA)) head which performs printing by one pass on record papers P which are continuously conveyed. Of course, the ink jet recording head 48 may also be applied to an image forming apparatus which performs so-called multi-pass image printing in which the ink jet recording head 48 is made to pass multiple times within a paper width.

Meanwhile, the nozzles 48*a* according to the present exemplary embodiment is assigned with numbers 1 to N to correspond to the N nozzles 48*a*-1, . . . , 48*a*-N, respectively. Hereinafter, the numbers will be referred to as "nozzle numbers".

Here, the arrangement of the nozzles 48*a* in the ink jet recording head 48 is not limited to that as described above. The nozzles 48*a* may be arranged in plural rows and the nozzles of the plural rows may be two-dimensionally arranged alternately in a zigzag form. Further, the ink jet recording head 48 is not limited to that configured as one ink jet recording head with a single body but may be divided into and configured as plural ink jet recording heads. In addition, the plural inject recording heads 48 may be arranged in a zigzag form.

Furthermore, a temperature sensor 82 and a moisture sensor 84 are arranged in the image forming section 16 as sensors for detecting environmental conditions.

The record paper P, which is formed with an image on the record surface thereof by the image forming section 16, is conveyed to the drying section 18 by the rotation of the image forming drum 44.

The drying section 18 includes an intermediate conveyance drum 28C and an ink drying drum 56. The rotation shaft of the intermediate conveyance drum 28C is connected to the rotation shaft of the image forming drum 44 via gears (not illustrated) and rotated by receiving the rotation force of the image forming drum 44.

The record paper P conveyed by the image forming drum 44 is delivered to the intermediate conveyance drum 28C via the holding members 34 of the intermediate conveyance drum 28C in a state it is held on the outer circumferential surface of the intermediate conveyance drum 28C.

The rotation shaft of the ink drying drum 56 is connected to the rotation shaft of the rotation shaft of the intermediate conveyance drum 28C via gears (not illustrated) and rotated by receiving the rotation force of the intermediate conveyance drum 28C.

The record paper P conveyed by the intermediate conveyance drum 28C is delivered to the ink drying drum 56 by the holding members 34 of the ink drying drum 56 and conveyed in a state in which it is held on the outer circumferential surface of the ink drying drum 56.

At the upper side of the ink drying drum 56, fan heaters 58 are disposed in the close vicinity of the outer circumferential surface of the ink drying drum 56. The solvent remaining in the image formed on the record paper P is removed by the warm wind by the fan heaters 58. The record paper P with the image of the record surface being dried by the drying section 18 is conveyed to the image fixing section 20 by the rotation of the ink drying drum 56.

The image fixing section 20 includes an intermediate conveyance drum 28D and an image fixing drum 62. The rotation shaft of the intermediate conveyance drum 28D is connected to the rotation shaft of the ink drying drum 56 via gears (not illustrated) and rotated by receiving the rotation force of the ink drying drum 56.

The record paper P conveyed by the ink drying drum 56 is delivered to the intermediate conveyance drum 28D via the holding members 34 of the intermediate conveyance drum 28D and conveyed in a state in which it is held on the outer circumferential surface of the intermediate conveyance drum 28D.

The rotation shaft of the image fixing drum 62 is connected to the rotation shaft of the intermediate conveyance drum 28D via gears (not illustrated) and rotated by receiving the rotation shaft of the intermediate conveyance drum 28D.

The record paper P conveyed by the intermediate conveyance drum 28D is delivered to the image fixing drum 62 through the holding members 34 of the image fixing drum 62 and conveyed in a state in which it is held on the outer circumferential surface of the image fixing drum 62.

At the upper side of the image fixing drum 62, a fixing roller 64 having a heater therein is disposed in a state in which the fixing roller 64 may be selectively pressed against or spaced apart from the outer circumferential surface of the image fixing drum 62. The record paper P held on the outer circumferential surface of the image fixing drum 62 is sandwiched between the outer circumferential surface of the image fixing drum 62 and the outer circumferential surface of the fixing roller 64, and heated by the heater in the state in which it is pressed against the outer circumferential surface of the fixing roller 64. Therefore, a color material of the image formed on the record surface of the record paper P is fused to the record paper P so that the image is fixed to the record paper P. The record paper to which the image is fixed by the image fixing section 20 is conveyed to the discharge conveyance section 24 by the rotation of the image fixing drum 62.

The discharge conveyance section 24 includes an intermediate conveyance drum 28E and a discharge conveyance drum 68. The rotation shaft of the intermediate conveyance drum 28E is connected to the rotation shaft of the image fixing drum 62 and rotated by receiving the rotation force of the image fixing drum 62.

The record paper P conveyed by the image fixing drum 62 is delivered to the intermediate conveyance drum 28E via the holding members 34 of the intermediate conveyance drum 28E and conveyed in a state in which it is held on the outer circumferential surface of the intermediate conveyance drum 28E.

The rotation shaft of the discharge conveyance drum 68 is connected to the rotation shaft of the intermediate conveyance drum 28E via gears (not illustrated) and rotated by receiving the rotation force of the intermediate conveyance drum 28E.

The record paper P conveyed by the intermediate conveyance drum 28E is delivered to the discharge conveyance drum 68 via the holding members 34 of the discharge conveyance drum 68 and conveyed to the discharge section 22 in a state where it is held on the circumferential surface of the discharge conveyance drum 68.

In addition, the image forming apparatus 10 according to the present exemplary embodiment includes an optical sensor 80 as a reading means for reading various test patterns to be described later. The optical sensor 80 is disposed to read the image printed on the record paper P while the record paper P is being conveyed to the discharge section 22 in a state in which the record paper P is held on the outer circumferential surface of the discharge conveyance drum 68.

The optical sensor 80 includes a light emission unit and a light reception unit. When the light emitted from the light emission unit is reflected by the record paper P and detected by the light reception unit, a reflective optical density of the print region of the record paper P (so-called an OD (Optical Density) value) (hereinafter, merely referred to as a "density") is measured. Meanwhile, as for the optical sensor 80 is a transmissive optical sensor may be used without being limited to a reflective optical sensor.

Figure 2:
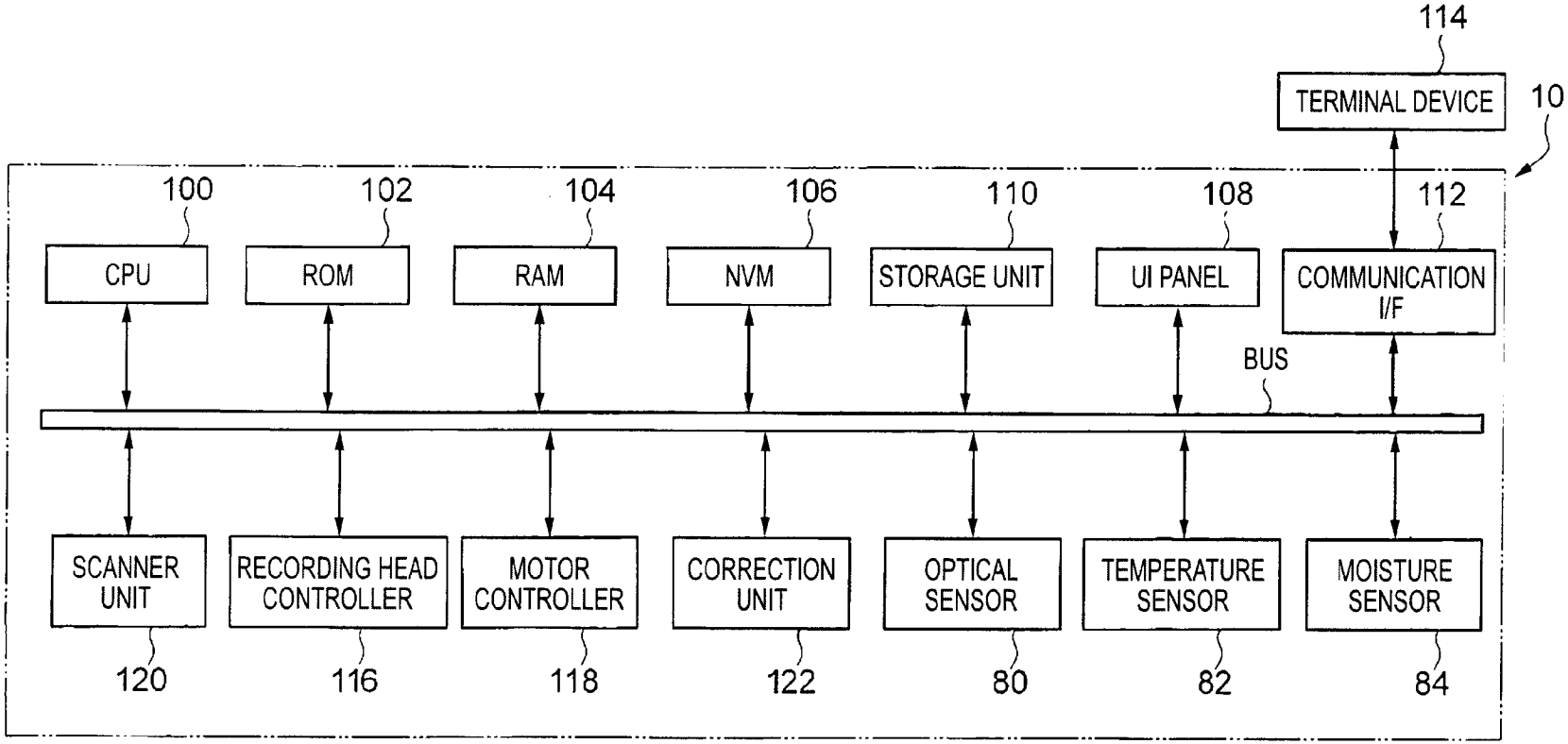
FIG. 2 is a block diagram illustrating a configuration of a principal portion of an electric system of the image forming apparatus according to the exemplary embodiment.

Next, a principal configuration of an electric system of the image forming apparatus 10 according to the present exemplary embodiment will be described with reference to FIG. 2.

As illustrated in the drawing, the image forming apparatus 10 includes a CPU (Central Processing Unit) 100, a ROM (Read Only Memory) 102, a RAM (Random Access Memory) 104, an NVM (Non-Volatile Memory) 106, a UI (User Interface) panel 108, and a communication interface 112.

The CPU 100 governs the operation of the entire image forming apparatus 10. The ROM 102 is a storage medium in which, for example, programs, such as a control program that controls the operation of the image forming apparatus 10 and a mask preparation program to be described later, and various parameters are stored in advance. The RAM 104 is a storage medium that is used as, for example, a job region when various programs are executed. The NVM 106 is a non-volatile storage medium which stores various information items which should be maintained even when a power switch of the apparatus is turned OFF.

The UI panel 108 is constituted with, for example, a touch panel display in which a transmissive touch panel is overlaid on a display so that various information items are displayed on the display surface of the display. In addition, the user may input desired an information item or an instruction, such as starting of a mask preparation program to be described later, by touching the touch panel.

The communication interface 112 is connected to a terminal device 114 such as a personal computer to receive various information items (e.g., image information indicating an image formed on a record paper P) from the terminal device 114 and, to transmit various information items (e.g., information indicating the operation state of the image forming apparatus 10.

The CPU 100, the ROM 102, the RAM 104, the NVM 106, the UI panel 108, and the communication interface 112 are connected with each other through a bus BUS such as a system bus. Accordingly, the CPU 100 performs each of accessing the ROM 102, the RAM 104 and the NVM 106, displaying various information to the UI panel 108, grasping the contents of a user's instruction for the UI panel 108, reception of various information items from the terminal device through the communication interface 112, and transmission of various information items to the terminal device 114 through the communication interface 112.

In addition, the image forming apparatus 10 includes a recording head controller 116 and a motor controller 118.

The recording head controller 116 controls the operation of the ink jet recording heads 48 according to an instruction of the CPU 100. The motor controller 118 controls the operation of the motor 30.

The recording head controller 116 and the motor control 118 are also connected to the bus BUS. Accordingly, the CPU 100 controls the operations of the recording head controller 116 and the motor controller 118.

The image forming apparatus 10 according to the present exemplary embodiment further includes a storage unit 110 in which, for example, mask files to be described later are stored, a scanner unit 120 which reads a manuscript, and a correction unit 122 that corrects a print defect on a record paper P caused by a defective nozzle (a nozzle which is abnormal in ejection of ink droplets). The storage unit 110, the scanner unit 120, and the correction unit 122 are also connected to the bus BUS and thus, controlled by the CPU 100.

Meanwhile, since the optical sensor 80, the temperature sensor 82 and the moisture sensor 84 as described above are also connected to the bus BUS, the CPU 100 may grasp the detected values by these sensors.

Recently, as the demand for improvement of image quality is increased, the number of the nozzles 48*a* arranged in the ink jet recording heads 48 is rapidly increased. For example, when a print resolution is 1200 dpi (dots per inch), about 10,000 nozzles are aligned in a paper width of A4 size (21 cm).

In each of the ink jet recording heads 48 provided with as many nozzles 48*a* as this scale, it is difficult to configure and maintain all the nozzles 48*a* to be capable of conducting normal ejection. Thus, each ink jet recording head 48 may include some defective nozzles stochastically in some cases. Defective aspects of the nozzles may include, for example, a non-ejection defect by which ink droplets are not ejected, a fine line defect by which the ejection amount of ink droplets is reduced, and a landing position deviation defect by which the flight of ink droplets is deflected.

Examples of detective nozzle detecting methods, there may be mentioned a method in which a test chart for detecting predetermined defective nozzles is printed by an ink jet recording head 48 to actually produce stripes and determination is made based on the result. It is a method of specifying, for example, nozzle numbers of defective nozzles from image information obtained by reading the printed test chart using, for example, an optical sensor.

In addition, when a defective nozzle is detected in at least one of the respective ink jet recording heads 48, the defective nozzle is typically made to stop the ejection of ink droplets based on the control by the CPU 100 (hereinafter, stopping the ejection of ink droplets may be referred to as "masking"). However, only with the masking, ink droplets are not normally ejected at the position corresponding to the stopped defective nozzle and thus, a white stripe is produced in printing on a record paper P. Thus, there is a case in which ink droplets are ejected to fill the white stripe using nozzles in the vicinity of the defective nozzle. Hereinafter, making the white stripe inconspicuous in this manner will be referred to as "correction". The details of the correction will be described later.

In general, a print defect caused by a defective nozzle may be supplemented as described above. However, in some cases, a white stripe may not be corrected as the number of defective nozzles to be masked (masking number) increases. For example, in making correction using neighboring nozzles at both sides of a defective nozzle, a case in which defective nozzles neighbor successively may correspond to such cases.

Further, with respect to increasing the masking number, when correction is made using ink droplets which are larger than ink droplets used in normal printing, in some cases, the graininess of the ink droplets may become conspicuous due to the correction when the print result on a record paper P is visually recognized and thus, the quality of a printed image may deteriorate.

Considering the above-described background, the image forming apparatus 10 of the present exemplary embodiment is adapted to prepare a plurality of mask files which indicate defective nozzles to be masked (non-ejection nozzles which do not eject ink droplets when forming an image) and have been acquired under different printing conditions, respectively, and to use different mask files according to actual printing conditions. By doing so, the number of nozzles is suppressed to a necessary minimum without excess or lack.

In the present exemplary embodiment, the printing number and printing density on record papers P in a case where printing is continuously performed on the record papers P in a predetermined print unit (job), the types of record papers P (as the examples of types of record papers P, there may be mentioned plain paper, coated paper, glossy paper), and an environmental condition (in the present exemplary embodiment, temperature and moisture) are presumed as the above-described printing conditions.

Here, the printing density refers to a ratio occupied by a print region in a record paper P and may also be referred to as, for example, a duty or coverage rate. In the image forming apparatus 10 of the present exemplary embodiment, the printing density is defined for each of the colors, yellow (Y), magenta (M), cyan (C), and black (K), including monochrome printing as well.

Here, descriptions will be made on the relationship between each printing condition and defects of nozzles.

First, in relation to the printing number, as the successive printing number is increased, the number of defective nozzles may be increased in some cases. For example, defective nozzles may occur when the printing operation progress and the printing number is increased even though no defective nozzle occurred when a printing operation of a job unit was initiated. This is caused since defective nozzles occur when the temperature of the ink jet recording heads 49 rises due to the increase of the successive printing number, and thus, mists (dispersed ink droplets) are adhered to the nozzle surfaces (the surface of the ink jet recording head 48 illustrated in FIG. 3), or air bubbles are trapped in the interior of the nozzles.

Such defective nozzles are not required to be masked in a job in which the successive printing number is small and may be masked in a job exceeding a predetermined printing number.

In addition, in connection with the printing density, only when the printing density is high, defective nozzles may occur in some cases. This is caused by reasons of, for example, fluid cross-talk by which the ejection of ink droplets from a certain nozzle 48*a* affects the ejection of ink droplets from other nozzles 48*a* since a plurality of nozzles 48*a* are connected to a common ink flow path due to the configuration of the ink jet recording head 48, the increase of temperature of ink jet recording head 48 due to the increase of the number of driven nozzles 48*a*, or the increase of mists adhered to the nozzles surfaces.

Such defective nozzles may be masked when printing of a job including, for example, an image of a relatively high printing density is performed, without needing to be masked when printing of a job including, for example, an image of a relatively low printing density.

Meanwhile, with respect to paper types, the bleeding of ink droplets is reduced and thus, a stripe is prone to be conspicuous, for example, in the order of plain paper, coated paper, and glossy paper. For that reason, it may be considered to make determination conditions for detecting nozzle defects more strict in the order of plain paper, coated paper and glossy paper, thereby uniformizing the conspicuousness degrees of stripes for respective papers. More specially, it may be considered, for example, to increase the threshold of a line width for determining the fine line defect or to reduce the permissible range of a position deviation for determining the landing position deviation defect.

In addition, with respect to the environmental conditions, no defective nozzle occurs under a normal environmental condition but defective nozzles may occur only under low temperature and low moisture condition or under high temperature and high moisture in some cases. This is caused, for example, when the ejecting state of ink droplets becomes unstable due to a change in viscosity of ink following an environmental change or a change in degree of drying of the ink.

Such a defective nozzle may be masked under low temperature and low moisture or under high temperature and high moisture without needing to be masked under the normal environmental condition.

Considering the characteristic of each printing condition as described above, the image forming apparatus 10 of the present exemplary embodiment is adapted to prepare a plurality of mask files indicating defective nozzles to be masked (non-ejection nozzles) and acquired under different printing conditions, respectively, and to use different mask files according to actual printing conditions.

Next, the operation of the image forming apparatus 10 according to the present exemplary embodiment will be described with reference to FIGS. 4 and 5. The present exemplary embodiment is an example of a case in which the printing number and printing density are considered as the printing conditions.

Here, the image forming apparatus 10 according to the present exemplary embodiment is configured to execute a processing of preparing a mask file and a processing of specifying a mask to be used in actual printing prior to the actual printing. The processes may be implemented by a software configuration using a computer by executing a program. In addition, it may be implemented by a hardware configuration employing, for example, ASIC (Application Specific Integrated Circuit) or a combination of a hardware configuration and a software configuration, without being limited to the implementation by the software configuration.

Hereinafter, descriptions will be made on a case in which the mask preparation processing and the mask specifying processing are implemented when the CPU 100 of the image forming apparatus 10 of the present exemplary embodiment executes the above-mentioned program. In this case, the program may be applied in a form of, for example, being installed in advance in the ROM 102, being provided in a state in which the program is stored in a computer-readable storage medium, or being transmitted through a wired or wireless communication means.

Here, as examples of a timing of executing the mask preparation program or the mask specifying program, there may be mentioned i) a case in which it is performed periodically per every time period pre-set by the user (for example, one week or one month) and ii) a case in which the user performs it precautionarily prior to printing, for example, an important print.

Figure 4:
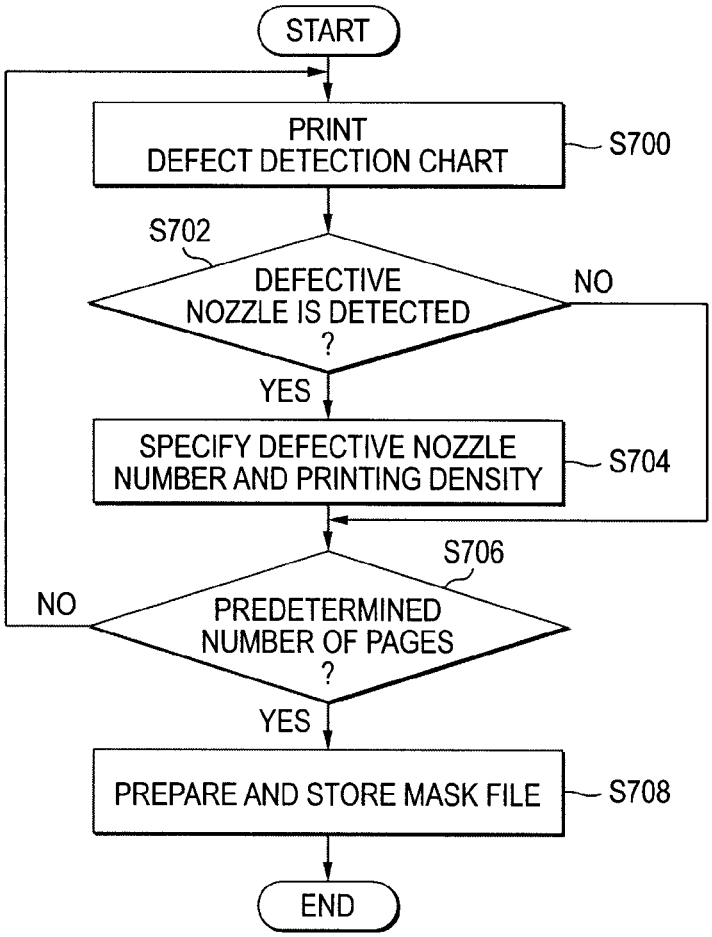
FIG. 4 is a flowchart illustrating a processing flow of a mask preparation program according to an exemplary embodiment.

FIG. 4 is a flowchart illustrating a flow of processing a mask preparation program according to the present exemplary embodiment. In the present exemplary embodiment, it is assumed that an instruction to execute the mask preparation processing has already been rendered by the user through, for example, the UI 108.

Referring to FIG. 4, in step S700, a defect detection chart (see FIG. 6) for specifying a defective nozzle is printed. In the next step S702, it is determined whether or not a defective nozzle is detected. When the determination is negative, the flow proceeds to step S706 to be described later and when the determination is positive, the flow proceeds to step S704. Meanwhile, the defect detection chart and a method of detecting a defective nozzle will be described in detail below.

In step S704, the nozzle number of a defective nozzle detected using the defect detection chart and a printing density where a defect occurred are specified. The specified nozzle number and printing density are stored in, for example, the storage unit 110 or RAM 104, first.

In the next step S706, it is determined whether or not a predetermined number of defect detection charts have been printed. When the determination is negative, the flow returns to step S700 to continue the printing of the defect detection chart, and when the determination is positive, the flow proceeds to step S708. Meanwhile, in the present exemplary embodiment, the predetermined number is set to 1,000 for each printing density set in a duty pattern 306 of a defective detection chart 300 to be described below.

In step S708, based on the defective nozzle number and printing density stored in, for example, the storage unit 110 or the RAM 104, mask files are prepared and the prepared mask files are stored in the storage unit 110. Then, the mask preparation program is ended.

In the image forming apparatus 10 according to the present exemplary embodiment, as will be described later, the printing conditions (in the present invention, printing number and printing density) of the mask files prepared by the present mask preparation program are extended to cover the printing conditions at the time of performing actual printing, and mask files specified by a mask specifying program as described below are prepared. The preparation of the mask files specified by the mask specifying program may be performed next to step S708 of the present mask program or may be performed in a separate program.

In such a case, the mask files prepared by the mask preparation program may be hold as data at the time of acquisition, or the mask files prepared in the mask preparation program may be changed and mask files specified by a mask specifying program.

Figure 5:
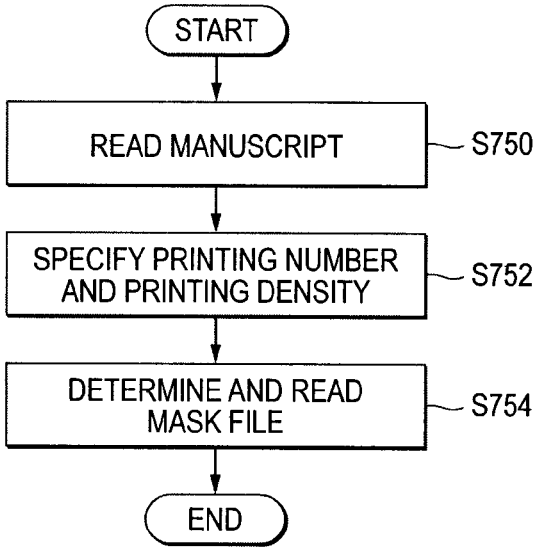
FIG. 5 is a flowchart illustrating a flow of processing a mask specifying program according to a first exemplary embodiment.

Meanwhile, FIG. 5 is a flowchart illustrating a flow of processing a mask specifying program according to the present exemplary embodiment. In the present exemplary embodiment, it is assumed that a manuscript related to the present job has already been set in the scanner unit 120 by the user through, for example, the UI panel 108, and then an instruction to set printing related information including the printing number and to start printing has been rendered.

Referring to FIG. 5, in step S750, the manuscript is read by the scanner unit 120 and converted into image information.

In the next step S752, the printing number and printing density are specified based on the printing related information set by the user and the image information of the read manuscript.

The printing number is specified from, for example, counting by a counter (not illustrated) provided in the scanner unit 120 and the set printing number. In addition, the printing density is specified as an average value based on, for example, the image information of the read manuscript.

Next, in step S754, a mask file is specified with reference to the storage unit 110 based on the printing number and printing density specified in step S752, the specified mask file is read from the storage unit 110, and is stored in, for example, the RAM 104. Then, the mask specifying program is ended.

Continuing from the present mask specifying program, an actual printing processing is executed. At that time, however, a defective nozzle is masked to become a non-ejection nozzle based on the mask file specified by executing the mask specifying program, and the correction is also made as desired.

Figure 6:
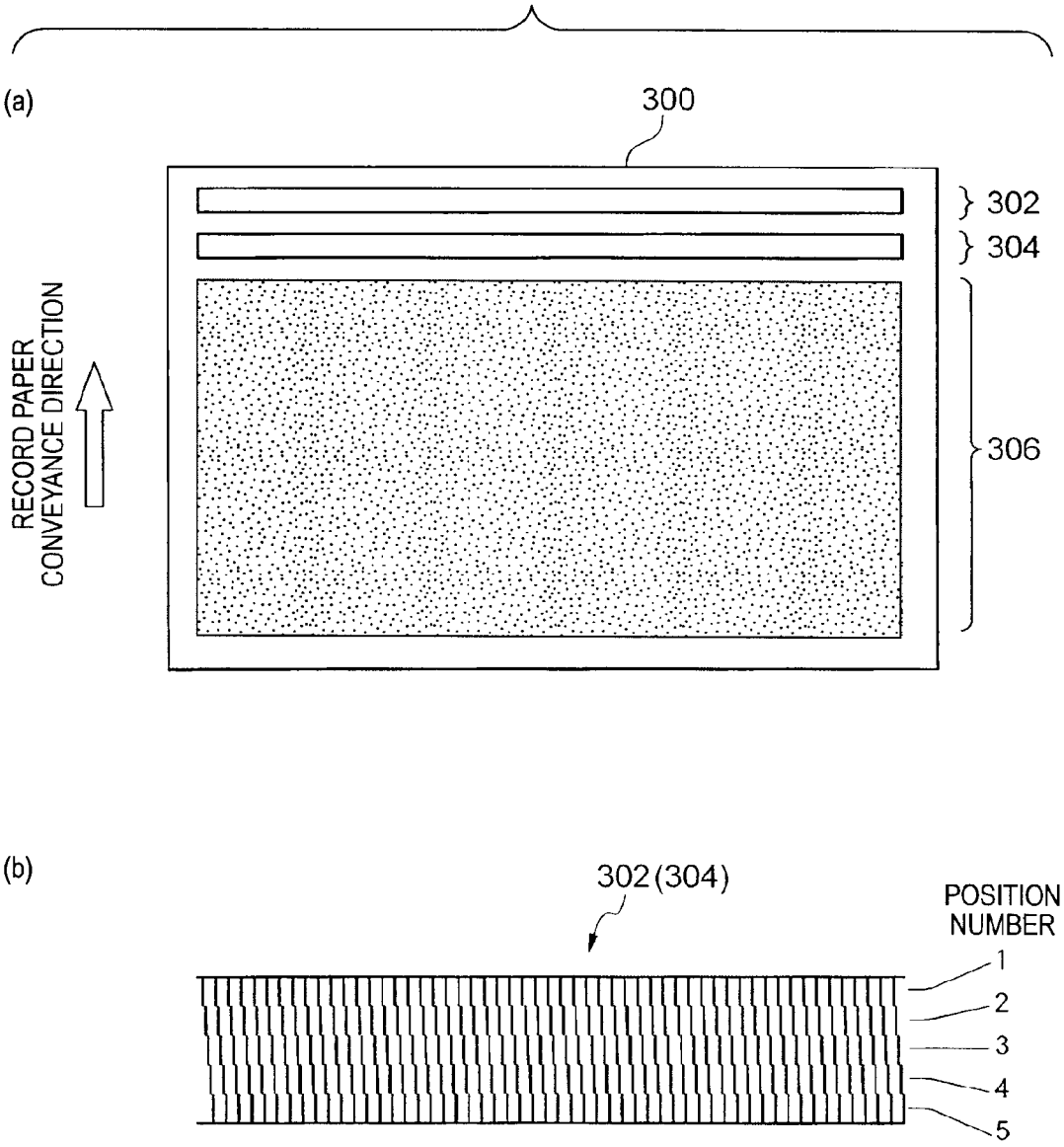
FIG. 6 shows schematic views illustrating defect detection charts according to the first exemplary embodiment.

Next, the defect detection chart 300 will be described with reference to FIG. 6. Since the image information representing the defect detection chart 300 has been stored in, for example, the storage unit 110 in advance, the image information may be read out to the CPU 100 to be used as desired.

In Part (a) of FIG. 6, the defect detection chart 300 is a defect detection chart of magenta M and black K (hereinbelow, "MK defect detection chart") and includes a defective nozzle specifying pattern of magenta M (hereinbelow, "M defective nozzle specifying pattern") 302, a defective nozzle specifying pattern of black K (hereinbelow, "K defective nozzle specifying pattern") 304, and a pattern of a predetermined printing density of magenta M and black K (hereinbelow, "MK duty pattern") 306.

The M defective nozzle specifying pattern 302 or the K defective nozzle specifying pattern 304 (hereinbelow, simply "defective nozzle specifying pattern") is a pattern for detecting a position of a defective nozzle and an aspect of the defect, and includes a so-called ladder pattern as illustrated in Part (b) of FIG. 6.

The defective nozzle specifying patterns 302, 304 in the present exemplary embodiment is patterns in which segments of a predetermined length are repeatedly printed in groups of five for the respective nozzles 48*a*-1 to 48*a*-N of the ink jet recording head 48 illustrated in FIG. 3. That is, printing is performed by the nozzles 48*a*-1 to 48*a*-5 according to position numbers 1 to 5 illustrated in Part (b) of FIG. 6, and then returning to the original, printing is performed by the nozzles 48*a*-6 to 48*a*-10 at the positions of position number 1 to 5. For the remaining nozzles 48*a*, printing is similarly performed to the nozzle 48*a*-N.

Meanwhile, the MK duty pattern 306 (hereinbelow, occasionally simply referred to as "duty pattern") is a pattern for confirming a defective state and a printing density where a defect occurs by actually generating a defect in which beta images (solid images) of a predetermined printing density are concurrently formed for magenta M and black K, respectively. Accordingly, when specifying the printing density in step S704 in FIG. 4, a plurality of defect detection charts 300 of different printing densities are printed.

Figure 7:
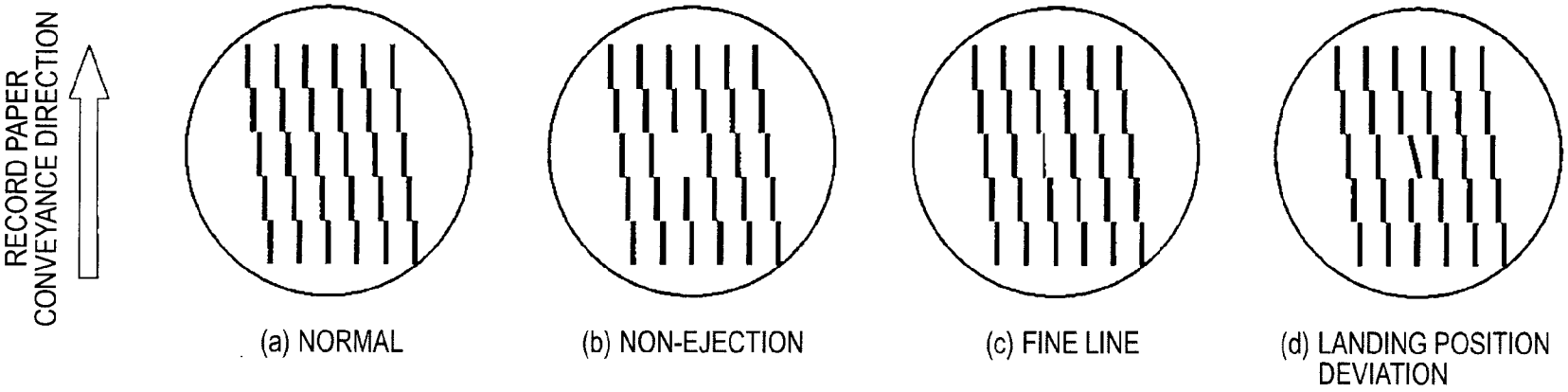
FIG. 7 shows schematic views illustrating examples of nozzle defect types according to an exemplary embodiment.

Parts (a) to (d) of FIG. 7 illustrate partially enlarged views of printing results of defective nozzle specifying patterns 302 and 304 according to aspects of respective nozzle defects.

Part (a) of FIG. 7 illustrates a case in which the ejection of the nozzles 48*a* is normal. When certain abnormality occurs in the nozzles and thus, the nozzles are in a state in which normal printing cannot be performed, each of the segments is caused to be deviated from the normal print pattern to the disorder state.

Part (b) of FIG. 7 is an example of a case in which the ejection of ink droplets from a nozzle 48*a* is disabled due to a certain reason (non-ejection defect) in which printing of a segment is omitted at the position corresponding to the nozzle 48*a* where this defect has occurred.

Part (c) of FIG. 7 is an example of a case in which the ejection amount of ink droplets from a nozzle 48*a* is reduced due to a certain reason (fine line defect) in which the segment printed at the position corresponding to the nozzle 48*a* where this defect has occurred became thinner.

Part (d) of FIG. 7 is an example of a case where flight deflection of ink droplets ejected from a nozzle 48*a* is caused due to a certain reason (landing position deviation defect) in which the segment at the position corresponding to the nozzle 48*a* where this defect has occurred is curved.

The image forming apparatus 10 according to the present exemplary embodiment detects the number and the defective state of a defective nozzle base on image information which is read from the defective nozzle specifying patterns 302, 304 of the defect detection chart 300 printed on a record paper P by the optical sensor 80 provided in the discharge conveyance section 24.

In addition, the image forming apparatus 10 according to the present exemplary embodiment defects a duty where a defect has occurred by reading the duty pattern 306 of the defect detection chart 300 printed on the record paper P by the optical sensor 80.

Although the methods of detecting a defective nozzle in the present exemplary embodiment has been described above using an MK defect detection chart as an example, a defective nozzle may also be detected for cyan C and yellow Y using a CY defect detection chart prepared in the same manner as the MK defect detection chart.

Meanwhile, the MK defect detection chart and the CY defect detection chart are separately prepared in order to avoid the fixation in the image fixing section 20 from becoming difficult due to the excessively large amount of ink droplets especially when the number of duty patterns is increased. However, the present invention is not limited to this and depending on the printing density of a pattern disposed in the duty pattern, M, Y, C and K may be integrally formed in a single defect detection chart or individually formed as four defect detection charts.

In addition, in the present exemplary embodiment, although it has been described that a defect detection chart 300 including a duty pattern 306 of a target printing density is printed for each printing density to specify a printing density where a print defect occurs as an example, the present invention is not limited thereto. For example, according to an object, a plurality of duty patterns 306 of different printing densities may be disposed so as to specify a printing density where a print defect occurs. The defect detection precision may be enhanced when one defect detection chart 300 is individually printed for each printing density. When a plurality of duty patterns of different printing densities are disposed on a single defect detection chart, the defect detection process may be simplified.

Next, descriptions will be made on mask files prepared with the mask preparation program of FIG. 4 and forms of storing to-be-specified mask files to the storage unit 110 with the mask specifying program of FIG. 5.

FIGS. 8A and 8B are conceptual views illustrating configurations when mask files prepared with the mask preparation program are stored in the storage unit 110.

The mask files prepared by the mask preparation program are stored in the storage unit 110 by being correlated with the printing number of record papers P and printing density at the time of preparation. FIG. 8A illustrates a case in which the mask files are stored in a matrix form according to the printing number and printing density as an example. Hereinbelow, the storage form will be referred to as a "mask file matrix" 400.

In the mask file matrix 400 illustrated in FIG. 8A, printing number is classified into four sections of up to $10^{th}$ page, up to $100^{th}$ page, up to $500^{th}$ page, and up to $1000^{th}$ page, and the printing density is classified into three sections of 20%, 60% and 100%. In addition, in each combination of printing number and printing density, a corresponding mask file assigned with an individual number in advance is stored. In the mask files, mainly, nozzles numbers of defective nozzles specified by the mask preparation program are stored.

For example, in the field of the combination of the printing number of up to 10 pages and the printing density of 20%, mask file no. 1 is stored.

FIG. 8B illustrates an example of stored contents of mask file no. 1. As illustrated in the drawing, in the mask file, "mask file number," "defective nozzle number," "printing density," "printing number," "paper type," and "environmental condition" (temperature and moisture) are stored. The "defective nozzle number" refers to nozzles numbers corresponding to nozzles which have become defective in ejection due to a certain reason. The nozzle numbers are 33, 158 and 3628 in the drawing.

Next, the "printing density," the "printing number," the "printing type," and the "environmental condition" are incidental data representing the printing conditions when mask file no. 1 was prepared.

The printing density refers to the printing density when mask file no. 1 was prepared and is 20% in the drawing. The printing density represents a printing density where a defect specified by reading a defect detection chart 300 printed on a record paper P at the time of preparing the mask file occurs.

In addition, the printing number is data representing pages in which defects actually have occurred when only the number of record papers P indicated by "up to $n_{th}$ pages" have been printed and in the drawing, $5^{th}$ to $10^{th}$ pages. The printing number represents the number of record papers P printed with the defect detection chart 300 at the time of preparing the mask file and the number is counted by, for example, a counter (not illustrated) which is provided in the image forming apparatus 10.

The paper type refers to the type of papers used when preparing mask file no. 1 and is plain paper in the drawing. The paper type represents the paper type set by the user when preparing mask files. Alternatively, the paper type may be specified by detecting the paper type of record papers P printed with the defect detection chart 300 by the optical sensor 80. Meanwhile, as the other paper types in the present exemplary embodiment, there are a coated paper and a glossy paper.

The temperature in the environmental condition refers to the temperature at the time of preparing mask file no. 1 and is 20° C. in the drawing. The moisture in the environmental condition refers to the moisture at the time of preparing the mask file no. 1 and is 50% in the drawing. The temperature and moisture are detected by reading detection signals from the temperature sensor 82 and the moisture sensor 84 provided in the image forming apparatus 10.

In mask files nos. 2 to 12, respective data are stored in the configuration as in mask file no. 1.

FIGS. 9A and 9B illustrate examples of forms of storing mask files to the storage unit 100 in a case where mask file matrix 400 prepared by the mask preparation program and stored in the storage unit 110 as described above is applied to actual printing. As described above, the printing conditions of mask file matrix 400 prepared by the mask preparation program is extended to cover the actual printing conditions and stored as mask file matrix 402.

That is, as illustrated in FIG. 9A, the printing number of the mask file matrix 402 is extended like 1 to 10 pages, 11 to 100 pages, 101 to 500 pages, and 501 to 1,000 pages, and the printing density is extended like <not lower than 0%, not higher than 20%>, <higher than 20%, not higher than 60%>, and <higher than 60%, not higher than 100%>.

In addition, when the printing number of record papers P is in the range of 1 to 10 pages and the printing density on the record papers P is not lower than 0% and not higher than 20%, mask file no. 1A is used. Mask file no. 1A is prepared based on mask file no. 1 of FIG. 8B.

FIG. 9B illustrates the stored contents of mask file no. 1A. The defective nozzle numbers are 33, 158 and 3628 like mask 1 of FIG. 8B. The printing density as incidental data is not lower than 0% and not higher than 20%, the printing number is 1 to 10 pages, the paper type is plain paper, the temperature is 15° C. to 25° C., and the moisture is 30% to 70%.

Likewise, as mask files no. 2A to no. 12A are likewise, mask files no. 2 to no. 12 are extended and stored.

In addition, in the actual printing, a mask file which meets the printing conditions specified by the mask specifying program (in the present exemplary embodiment, the respective conditions of the printing number and printing density) is specified mask file matrix 402 and defective nozzles designated with this mask file are masked and become the non-ejection nozzles.

The printing number is obtained by multiplying a value obtained by reading an actually printed manuscript and the printing number input from, for example, the UI panel 108. In addition, the printing density is obtained by calculating an average printing density from the image information read by the scanner unit 120 from the actually printed manuscript. Alternatively, the printing density may be a form which is input through, for example, the UI panel 108 in advance by the user.

In the image forming apparatus 10 according to the present exemplary embodiment, specified defective nozzles are masked and become non-ejection nozzles, and correction to the defective nozzles is executed as desired. FIGS. 10A to 10D are explanatory views for describing the correction. Meanwhile, the correction according to the present exemplary embodiment is executed by controlling the correction unit 122 by the CPU 100.

Figure 10A:
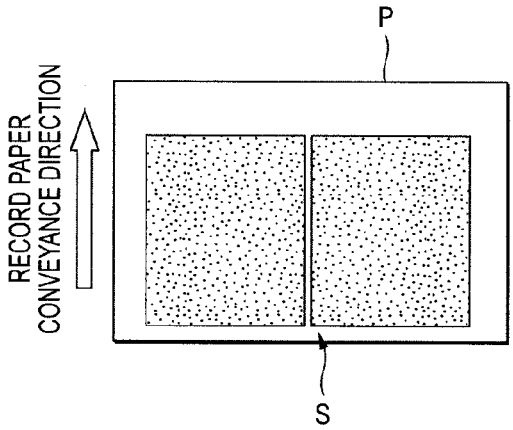
FIGS. 10A to 10D are explanatory views for describing a correction processing according to an exemplary embodiment.
Figure 10C:
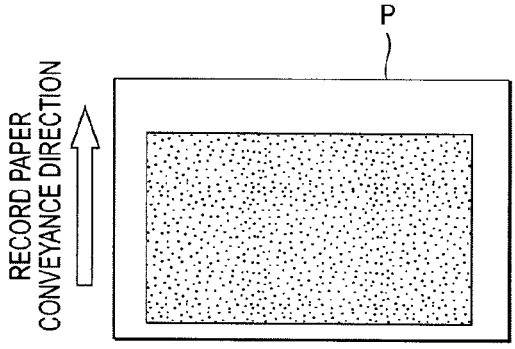
Figure 10B:
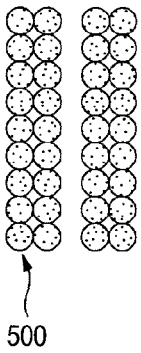

FIG. 10A illustrates a beta image printed on a record paper P after a defective nozzle is masked, and FIG. 10B illustrates a state in which ink droplets 500 landed on the record paper P in which the ink droplets 500 were ejected from two rows of nozzles at each of the both sides of the defective nozzle when the beta image was printed. As illustrated in these drawings, in many cases, a white line S occurs merely by masking the defective nozzle.

Figure 10D:
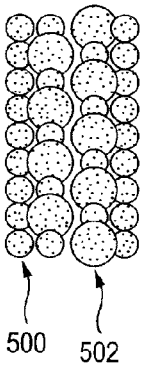

FIG. 10C illustrates a beta image printed on the record paper P in a case in which the beta image was corrected using the nozzles at the both sides of the defective nozzle, and FIG. 10D illustrates a state in which ink droplets landed on the record paper, in which the ink droplets were ejected from two rows of nozzles at each of both sides of the defective nozzle when the beta image was printed. In the present exemplary embodiment, the ink droplets from the nozzles that execute correction are formed in large droplets 502 which are large ink droplets as compared to those when normal printing is performed.

As illustrated in FIG. 10C, when the present correction is performed, the white stripe illustrated in FIG. 10A is quite unnoticeable.

Here, in the present exemplary embodiment, the large droplets 502 are ejected from the nozzles when performing correction. However, the correction may be performed with a normal ejection amount of ink droplets 500 without being necessarily limited thereto. In such a case, for example, the number of ejected ink droplets 500 may be increased to perform the correction.

In addition, the nozzles used for executing the correction do not necessarily have to be the nozzles of both sides of the defective nozzle. The nozzles may be those located at any one side of the defective nozzle. Further, the nozzles do not necessarily have to be those located adjacent to the defective nozzle.

As will be apparent from the above description, with the image forming apparatus 10 according to the present exemplary embodiment, the number of defective nozzles (non-ejection nozzles) which stop ejection may be suppressed while suppressing the deterioration of quality of a formed image.

[Second Exemplary Embodiment]

The present exemplary embodiment is an exemplary embodiment in which the paper type and the environmental condition in the first exemplary embodiment are further considered. That is, in the present exemplary embodiment, a plurality of mask files are prepared by a mask preparation program in consideration of printing numbers, printing density, paper type and environmental condition as printing conditions and a mask file which meets the printing conditions is selected from the plurality of mask files by the mask specifying program prior to actual printing.

Figure 11:
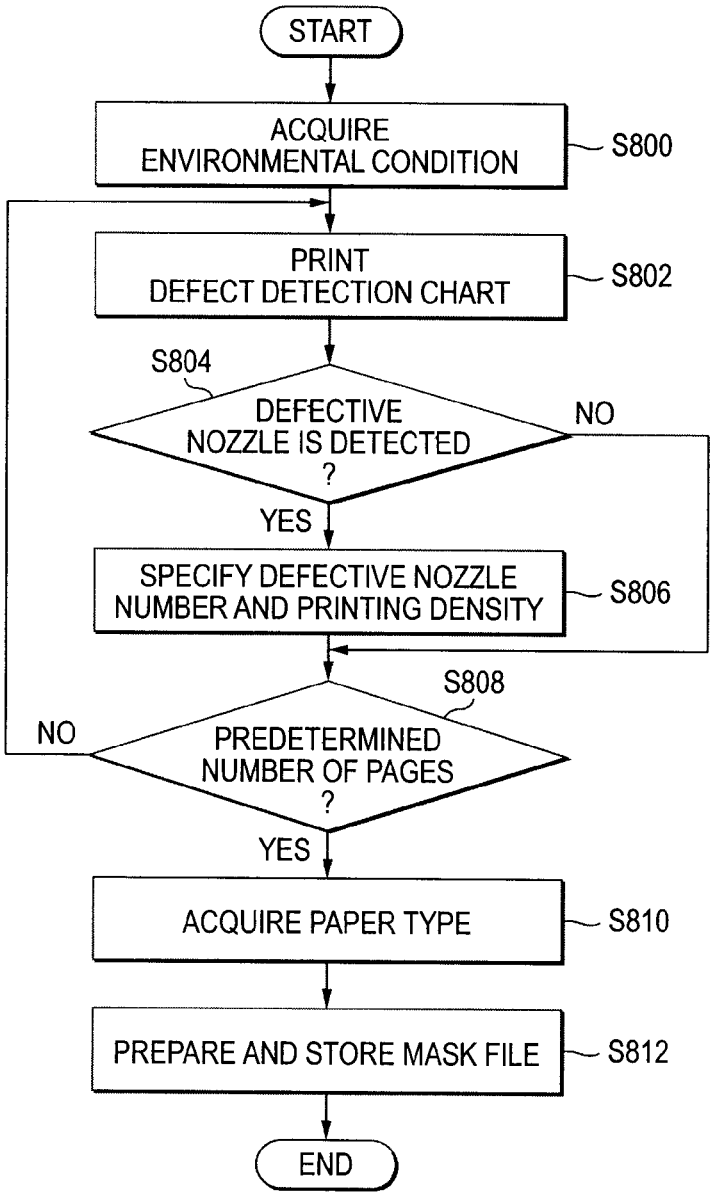
FIG. 11 is a flowchart illustrating a flow of processing a mask preparation program according to a second exemplary embodiment.
Figure 12:
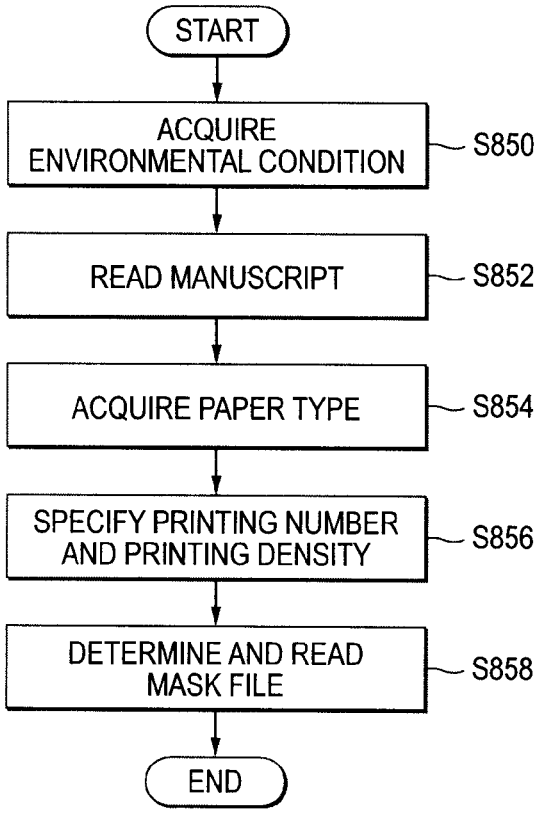
FIG. 12 is a flowchart illustrating a flow of processing a mask specifying program according to the second exemplary embodiment.

Referring to FIGS. 11 and 12, the operation of the image forming apparatus 10 according to the present exemplary embodiment will be described.

FIG. 11 is a flowchart illustrating a flow of processing a mask preparation program according to the present exemplary embodiment. The present flowchart adds step S800 and step S810 to the flowchart of the mask preparation program illustrated in FIG. 4. In the present exemplary embodiment, it is assumed that an instruction to process mask preparation has already been rendered by the user through, for example, the UI panel 108. In addition, it is assumed that the environmental condition (temperature and moisture) around the image forming apparatus 10 has already been set by the user.

Referring to FIG. 11, in step S800, the environmental condition, i.e., the temperature and moisture are detected and acquired by the temperature sensor 82 and the moisture sensor 84, respectively.

Since steps S802 to S804 in FIG. 11 are the same as steps S700 to S706 of FIG. 4, the descriptions thereof will be omitted.

In the next step S810, the paper type is acquired. The paper type is determined based on the image information obtained by reading a defect detection chart by the optical sensor 80.

Here, as described above, when changing the determination conditions for detecting a defective nozzle, the paper type may be input from, for example, the UI panel 108 when the user instructs the execution of the present mask preparation program. In such a case, the position of step S810 may be located at any one position before or after step S800, and depending on the input paper type, the determination conditions for detecting a defective nozzle in step S804 are changed.

In the next step S812, a mask file is prepared and stored in the storage unit 110 and then the present mask preparation program is ended. In preparing and processing a mask file according to the present exemplary embodiment, the mask preparation program is executed per every required environmental condition and every paper type. In this manner, in the present mask preparation program, the printing number, printing density, paper type and environmental condition are correlated to a defective nozzle number and stored in the storage unit 110.

FIG. 12 is a flowchart illustrating a flow of processing the mask specifying program according to the present exemplary embodiment and adds step S850 and S854 to the flowchart of FIG. 5. In the present exemplary embodiment, it is assumed that a manuscript related to the present job has been already set in the scanner unit 120 through, for example, the UI panel 108 by the user, and then an instruction to set printing related information which also includes, for example, the printing number, and to start printing has been rendered.

Referring to FIG. 12, first, in step S850, the temperature and moisture, which are the environmental condition, are acquired based on the data detected by the temperature sensor 82 and the moisture sensor 84, respectively.

In the next step S852, the manuscript is read by the scanner unit 120 and then, in the next step S854, the paper type is acquired. In the present exemplary embodiment, the paper type is determined based on the image information read by the scanner unit 120. However, without being limited thereto, the paper type may be input from, for example, the UI panel 108 when the user stars printing. In the latter case, the position of step S854 may be located at a position before or after step S850.

In the next step 856, the printing number and printing density are specified based on the manuscript read by the scanner unit 120. As for the printing density, an average printing density may be calculated based on the image information read from the manuscript.

Next, description will be made on the stored forms of mask files, which are obtained as a result of executing the mask preparation program, in the storage unit 110 and stored forms of mask files in the storage unit 110 when the mask specifying program is executed.

Parts (a) to (c) of FIG. 13 are conceptual views illustrating the forms of mask files stored in the storage unit for plain paper, coated paper and glossy paper which are the paper types, respectively.

Part (a) of FIG. 13 illustrates conditional mask file 510 (which includes mask file matrix 410 composed of mask file no. 1 to mask file no. 12) in a case in which the paper type is plain paper, Part (b) of FIG. 13 illustrates conditional mask file 510 (which includes mask file matrix 412 composed of mask file no. 13 to mask file no. 24) in a case in which the paper type is coated paper, and Part (c) of FIG. 13 illustrates conditional mask file 514 (which includes mask file matrix 414 composed of mask file no. 25 to mask file no. 36) in a case in which the paper type is glossy paper. The environmental conditions of conditional mask files 510, 512, 514 of Parts (a) to (c) of FIG. 13 are 20° C. and 50%, which represents that the mask files were acquired at these environmental conditions. That is, in the field of environmental condition, the values of temperature and moisture at the time when the mask files were actually prepared are stored. Hereinbelow, a group of mask files composed of conditional mask files 510, 512, 514 will be referred to as mask file group 1.

The present exemplary embodiment further includes mask file groups (not illustrated) composed of conditional mask files which are the same as the conditional mask files 510, 512, 514 and acquired under the environmental conditions of low temperature and low moisture, and high temperature and high moisture. Hereinbelow, these mask file groups are referred to as second mask file group and third mask file group, respectively. That is, the mask files according to the present exemplary embodiment are configured to include three mask file groups.

The second mask file group includes three conditional mask files corresponding to low temperature and low moisture. One of the conditional mask files includes a mask file matrix which includes twelve mask files (mask files nos. 37 to 48) as in mask file group 1. Likewise, another conditional mask file includes a mask file matrix which includes twelve mask files (for example, mask files nos. 49 to 60) and the other conditional mask file includes a mask file matrix which includes twelve mask files (for example, mask files nos. 61 to 72).

In addition, the third mask file group includes three conditional mask files corresponding to high temperature and high moisture. One of the conditional mask files which includes a mask file matrix which includes twelve mask files (mask files nos. 73 to 84) as in mask file group 1. Likewise, another conditional mask file includes a mask file matrix which includes twelve mask files (mask files nos. 85 to 96) and the other conditional mask file includes a mask file matrix which includes twelve mask files (mask files nos. 97 to 108). Accordingly, the total number of mask files included in the present exemplary embodiment is 108 (36×3=108). The data stored form to each of the mask files (mask file no. 1 to mask file no. 108) is as illustrated in FIG. 8B.

Here, the environmental conditions according to the present exemplary embodiment are classified as follows.

Temperature

Normal: 15° C. to 25° C.

Low temperature: lower than 15° C.

High temperature: higher than 25° C.

Moisture

Normal: 30% to 70%

Low moisture: lower than 30%

High moisture: higher than 70%

Accordingly, the low temperature and low moisture condition and the high temperature and high moisture condition are conditions at the time of preparing mask files, and each mask file is acquired under any numerical conditions of the above ranges. For example, a mask file acquired at the temperature of 14° C. and the moisture of 25% belongs to the second mask file group since it is acquired under the low temperature and low moisture condition, and a mask file acquired at the temperature of 29° C. and the moisture of 80% belongs to the third mask file group since it is acquired under the high temperature and high moisture condition.

Parts (a) to (c) of FIG. 14 conceptually illustrate the stored forms of mask file group 1A in the storage unit among three mask file groups specified by a mask specifying group at the time of actual printing. These mask file groups are those prepared based on the mask file groups as described above, respectively, and the printing conditions are extended to actual printing conditions as illustrated in FIGS. 9A and 9B. Accordingly, the mask file group 1A is a mask file group specified and used at the time of actual printing under the normal environmental condition, another mask file group is a mask file group specified and used at the time of actual printing under the low temperature and low moisture environmental condition, and the other mask file group is a mask file group specified and used at the time of actual printing under the high temperature and high moisture environmental condition.

As illustrated in Parts (a) to (c) of FIG. 14, mask file group 1A includes conditional mask files 510A, 512A, 514A. As in FIG. 13, conditional mask files 510A, 512A, 514A are the conditional mask files which correspond to plain paper, coated paper and glossy paper, respectively. In conditional mask files 510A, 512A, 514A, the environmental condition field is extended to the normal condition, i.e., the temperature of 15° C. to 25° C. and the moisture of 30% to 70%. Mask file matrix 410A to mask file matrix 414A, which belong to conditional mask file 510A to conditional mask file 514A, respectively, are also extended in relation to printing number and printing density similarly to FIG. 9B (not illustrated).

Similarly, in said another mask group (including three conditional mask files), the low temperature and low moisture condition (i.e. the temperature of lower than 15° C. and the moisture of lower than 30%) is stored at the environmental condition field of each conditional mask file, and in the other mask file group (including three conditional mask files), the high temperature and high moisture condition (i.e. the temperature of higher than 25° C. and the moisture of higher than 70%) is stored at the environmental condition field of each conditional mask file (not illustrated).

As described above, based on the three mask file group including the mask file group 1A extended from the mask file groups including mask file group 1 and stored in the storage unit 110, the mask specifying program illustrated in the flowchart of FIG. 12 is executed prior to actual printing. Then, when the actual printing is started, defective nozzles are masked to become non-ejection nozzles based on the mask files specified by the present program and correction to the defective nozzle is performed as desired.

Here, in the above-described exemplary embodiments, with respect to four printing conditions, an aspect in which a mask file matrix based on printing number and printing density is prepared for each paper type and each environmental condition has been described as an example. However, the present invention is not limited to this. A printing condition that the user particularly desires to consider may be selected and a mask file matrix related to the printing condition may be prepared. For example, a mask file matrix may be prepared in connection with only one of paper type and environmental condition. In such a case, with respect to the paper type, for example, under the normal environmental condition, only conditional mask files 510, 512, 514 illustrated in Parts (a) to (c) of FIG. 13 and only conditional mask files 510, 512, 514 may be used. In addition, with respect to the environmental condition, for example, under the condition of plain paper, only conditional mask files including conditional mask file 510 may be prepared and conditional mask files including conditional mask file 510A may be used.

Further, with respect to the environmental conditions, it is not necessary to prepare conditional mask files under the conditions of normal, low temperature and lower moisture, and high temperature and high moisture exemplified in the above-described exemplary embodiments, and conditional mask files may be prepared under an environmental condition of a range which may be set by the user (e.g., a range which may be set in an air conditioning installation).

Further, based on four printing conditions, four-dimensional mask files may be prepared. Alternatively, the mask files may be prepared with the four printing conditions, respectively. In the latter case, when defective nozzles which overlap in the mask files of the individual printing conditions are present, defective nozzles obtained by calculating the logical product of the mask files of supposing printing conditions may be masked to become non-ejection nozzles. Further, defective nozzle obtained by calculating the logical sum of the mask files of the individual printing conditions may be masked to become non-ejection nozzles. By majority, i.e., defective nozzles determined as defective nozzles by, for example, three printing conditions among the four printing conditions may be masked to become non-ejection nozzles.

Further, in each of the above-described exemplary embodiments, there has been described an aspect in which mask files are newly prepared each time when they are prepared has been described as an example. However, the present invention is not limited thereto and may use an aspect in which printing executed in the past is considered. For example, when a mask file is prepared in a state the same mask file has been always stored in the storage unit 110, the mask file may be updated. In such a case, what is needed is that step S708 of FIG. 4 or step S812 of FIG. 12 is to be "prepare/update mask file".

In addition, in each of the above exemplary embodiments, an aspect has been described in which the user prepares mask files when using the image forming apparatus according to the present invention as an example. However, the present invention is not limited thereto and may also use an aspect in which a mask file is prepared prior to shipment of the image forming apparatus and stored in, for example, the storage unit 110 as data.

Further, in each of the above-described exemplary embodiments, an form has been described in which mask files are specified prior to a job and the job is executed based on the specified files as an example. However, the present invention is not limited there to and may also use an aspect in which mask files are changed during a job. For example, when an average printing density is changed during one job, other mask files of different printing densities may be changed one another. In such a case, in step S754 of the flowchart of FIG. 5, a plurality of mask files of different printing densities are determined and read out. Further, when an environmental temperature detected by the temperature sensor 82 during one job is changed, mask files of different environmental temperatures may be changed one another. In such a case, in step S858, a plurality of mask files of different environmental temperatures are determined and read out.

In addition, in each of the above-described exemplary embodiments, an aspect has been described in which mask files for masking defective nozzles are prepared as an example. However, conversely, it may be, of course, possible that files, in which nozzle numbers of normal nozzles which are normal in ejection are stored, may be prepared and the files may be specified when executing actual printing. In such a case, in step S704, nozzle numbers obtained by removing defective nozzle numbers from the entire nozzle numbers are specified and in step S708, files may be prepared based on the specified nozzle numbers. This may be similarly applied to step S806 and step S812 of FIG. 11.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of nozzles that include a normal nozzle which is normal in ejection of liquid droplets and an abnormal nozzle which is abnormal in ejection of liquid droplets;

a storage unit in which nozzle information capable of determining a non-ejection nozzle which does not eject liquid droplets at the time of image forming is stored to correspond to each of a plurality of different conditions, the conditions being at least one of successive forming number when an image is successively formed on a plurality of record mediums, an image forming density for the record mediums, a type of the record mediums, and an environmental condition; and a control unit that performs a control based on the nozzle information corresponding to at least one of the conditions related to the image forming such that liquid droplets are not ejected from the non-ejection nozzle, and performs a control based on the image information such that liquid droplets are ejected from ejection nozzles except the non-ejection nozzle among the plurality of nozzles.

2. The image forming apparatus of claim 1, wherein, when a plurality of conditions related to the image forming are present, the control unit performs a control such that liquid droplets are not ejected from the non-ejection nozzle determined by combining non-ejection nozzles represented by nozzle information corresponding to each of the plurality of conditions.

3. The image forming apparatus of claim 1, wherein, when at least one of the conditions related to the image forming is changed according to a lapsed time, a control is performed such that the at least one of the conditions is changed according to the lapsed time so that liquid droplets are not ejected from the non-ejection nozzle determined based on the nozzle information corresponding to the changed condition.

4. The image forming apparatus of claim 1, further comprising:

a reading unit that reads an image formed on a record medium, wherein the nozzle information is stored in the storage unit based on a result obtained when the reading unit reads a test image for detecting nozzle information capable of determining the non-ejection nozzle which does not eject liquid droplets at the time of image forming for each of the plurality of different conditions.

5. The image forming apparatus of claim 1, wherein the control unit performs corrects the image information and performs a control such that the image is formed in a region corresponding to the non-ejection nozzle in a record medium by the liquid droplets ejected from the ejection nozzle.

6. The image forming apparatus of claim 1, wherein the control unit causes image forming in a direction intersecting with a record medium conveyance direction to be conducted all at once and based on the image information, performs a control such liquid droplets are ejected from the ejection nozzle.

7. An image forming method of an image forming apparatus, the image forming apparatus comprising:

a plurality of nozzles that include a normal nozzle which is normal in ejection of liquid droplets and an abnormal nozzle which is abnormal in ejection of liquid droplets; and a storage unit in which nozzle information capable of determining a non-ejection nozzle which does not eject liquid droplets at the time of image forming is stored to correspond to each of a plurality of different conditions, the conditions being at least one of successive forming number when an image is successively formed on a plurality of record mediums, an image forming density for the record mediums, a type of the record mediums, and an environmental condition, and the image forming method comprising:

performing a control based on the nozzle information corresponding to at least one of the conditions related to the image forming such that liquid droplets are not ejected from the non-ejection nozzle; and performing a control based on the image information such that liquid droplets are ejected from the nozzles except the non-ejection nozzle among the plurality of nozzles.

8. A non-transitory computer readable medium storing a program causing a computer to execute a process for an image forming of an image forming apparatus, the image forming apparatus comprising:

a plurality of nozzles that include a normal nozzle which is normal in ejection of liquid droplets and an abnormal nozzle which is abnormal in ejection of liquid droplets; and a storage unit in which nozzle information capable of determining a non-ejection nozzle which does not eject liquid droplets at the time of image forming is stored to correspond to each of a plurality of different conditions, the conditions being at least one of successive forming number when an image is successively formed on a plurality of record mediums, an image forming density for the record mediums, a type of the record mediums, and an environmental condition, and the process comprising:

performing a control based on the nozzle information corresponding to at least one of the conditions related to the image forming such that liquid droplets are not ejected from the non-ejection nozzle; and performing a control based on the image information such that liquid droplets are ejected from the nozzles except the non-ejection nozzle among the plurality of nozzles.

* * * * *